US007700526B2

(12) United States Patent
Yamamoto

(10) Patent No.: US 7,700,526 B2
(45) Date of Patent: Apr. 20, 2010

(54) PROCESS FOR MACHINING METAL AND HIGH PERFORMANCE AQUEOUS LUBRICANT THEREFOR

(76) Inventor: Osamu Yamamoto, 4-1 Oaza Daimon, Inuyama-shi, Aichi (JP)

( * ) Notice: Subject to any disclaimer, the term of this patent is extended or adjusted under 35 U.S.C. 154(b) by 420 days.

(21) Appl. No.: 11/047,622

(22) Filed: Feb. 2, 2005

(65) Prior Publication Data

US 2006/0172897 A1 Aug. 3, 2006

(51) Int. Cl.
*C10M 125/26* (2006.01)
*C10M 169/04* (2006.01)

(52) U.S. Cl. ..... 508/155; 508/110

(58) Field of Classification Search ..... 508/155, 508/110

See application file for complete search history.

(56) References Cited

U.S. PATENT DOCUMENTS

| | | | | |
|---|---|---|---|---|
| 4,882,077 | A * | 11/1989 | Cox | 508/463 |
| 5,985,802 | A * | 11/1999 | Watari et al. | 508/155 |
| 2002/0193263 | A1* | 12/2002 | Yoneta et al. | 508/517 |

FOREIGN PATENT DOCUMENTS

| | | |
|---|---|---|
| JP | 10-316989 | 12/1998 |
| JP | 10-330775 | 12/1998 |
| JP | 11-166190 | 6/1999 |
| JP | 2004-182879 | 7/2004 |

OTHER PUBLICATIONS

Saunders, Brian R., "Reversible Temperature-Induced Gelation of Oil-in-water Emulsions: A New Family of Responsive Emulsions" Retrieved from the internet at <http://www.uk-pcf.org/surrey%20abstracts/Saunders%202.htm> on May 15, 2007.*

* cited by examiner

*Primary Examiner*—Glenn Caldarola
*Assistant Examiner*—Jim Goloboy
(74) *Attorney, Agent, or Firm*—Morrison & Foerster LLP

(57) ABSTRACT

A water-dilutable emulsion lubricant for machining, exhibiting improved dispersibility and emulsion stability, by emulsifying an oil system, composed of a base oil and an effective amount of fine particles of boron nitride of a crystalline turbostratic structure, dispersed in the base oil, in a water system, using an emulsifier. The lubricant is free from heavy metals, e.g., molybdenum disulfide and useful for machining difficult-to-cut materials such as Ti alloys and Inconel. The lubricant is effective even at a diluted state comprising 0.001% up to 0.1% by weight of crystalline t-BN.

35 Claims, No Drawings

PROCESS FOR MACHINING METAL AND HIGH PERFORMANCE AQUEOUS LUBRICANT THEREFOR

FIELD OF THE INVENTION

This invention relates to a process for machining a material, particularly metal, using a water-dilutable oil in water (O/W) emulsion lubricant, such as metal cutting and grinding: and further plastic metal machining. More particularly, it relates to a water-dilutable lubricant for metal machining, which exhibits a superior effect in improving the lubricating performance.

BACKGROUND OF THE INVENTION

Among cutting oil agents, used extensively for cutting and grinding, there are mineral-oil-based cutting agents, and water-dilutable O/W emulsion cutting agents, containing e.g. a mineral oil, surfactants and organic amines, and which are used on dilution in water. These cutting oil agents may be added by a compound called an extreme pressure additive for improving the lubricating performance of the oil agents (see for example the Patent Publication 1).

As typical of these extreme pressure additives are chlorine containing compounds, sulfur containing compounds and molybdenum containing compounds. Since waste oils are produced after use of the oil agents for metal machining, chlorine gases, hydrogen chloride gases or sulfur oxide gases may be generated, in case of incineration of the waste oils, thus possibly damaging or shortening the useful life of the incinerating furnaces. Moreover, certain chlorine based additives are known to yield dioxin. On the other hand, strict management is needed for molybdenum compounds which have become the subject of regulations by the PRTR law.

These extreme pressure additives are known as indispensable for improving the lubricating performance of the oil agent. Recently, from the perspective of saving global resources and preventing the worsening of the global environment, it has become a desideratum to develop a lubricant (or coolant) more amenable to the global environment and which will help extend the useful life of e.g. a tool as much as possible.

For overcoming this problem, the present inventors have already devised a high performance lubricating oil comprising an effective amount of fine particles of boron nitride in a liquid component (see for example the Patent Publication 2). These lubricant oils have been confirmed to exhibit superior performance for cutting, grinding and/or polishing, thanks to the meritorious effect of boron nitride content thereof. However, when used as a non-water-soluble cutting agent, these lubricating oils are susceptible to inflammation in spite of superior performance. Hence, in large-sized equipment in need of a large quantity of the oil agent, the general preference is to use water-soluble cutting oils for combating the risk of conflagration. It should be noted that boron nitride, if used as an extreme pressure agent for cutting oils, gives many advantageous features in cost or in operating efficiency, such as prolonged useful life of a blade or improved cutting speed. However, boron nitride suffers from the drawback that it is solid and hence cannot be dissolved in the cutting oil agent, and that, since it has a large specific gravity which is approximately 2.27, it is precipitated if directly dispersed in the cutting oil agent. On the other hand, report has been made of a water dispersion lubricant for plastic machining containing an inorganic solid lubricant (see, for example, the Patent Publication 3). However, this type of the lubricant is limited to use in forging, rolling, line drawing and in extrusion. Additionally, the size of the oil droplet is intended to be fairly large, being 50 μm or more, or 5 μm or more at the minimum, if estimation is made on the basis of the particle size of the solid lubricant used. For metal machining, such as metal cutting, grinding or polishing, a smaller particle size is preferred in light of the machining performance. The particle size of the oil droplet of the routine water-soluble oil agent for metal machining, called the emulsion type, is 2 to 5 μm and is preferably is to be uniformly 5 μm or less in light of use of a filtration device in case of re-use on circulation. This requirement is not met with the water dispersion lubricant. Consequently, there is a demand for a high performance lubricant for metal machining which is water-soluble (or dilutable) and which exhibits superior dispersibility of boron nitride.

[Patent Publication 1]

Publication of JP Patent Kokai JP-A-11-166190

[Patent Publication 2]

JP Patent No. 2911113

[Patent Publication 3]

Patent Publication of JP Patent Kokai JP-A-10-316989

Further, there is strong demand in the art for an efficient process for machining metal, particularly those which are difficult to machine, such as titanium alloys, Inconel or the like, particularly with a less load to the environment.

SUMMARY OF THE DISCLOSURE

It is therefore an object of the present invention to provide a water-soluble lubricant for machining a material such as metal, which is not pollutant to environment, free from heavy metals, such as molybdenum disulfide, and which does not yield harmful substances, such as dioxin, on discarding used oil agent as wastes. The conventional term "water-soluble" used hereinafter refers to "water-dilutable".

It is another object of the present invention to provide a water-soluble oil agent for machining, which is easy to handle, not liable to the risk of conflagration, free from the problem of flocculation and precipitation of fine particles of boron nitride used as an extreme pressure agent, and which is not in need of agitation and re-dispersion on the part of the user employing the oil agent.

It is still further object of the present invention to provide an efficient process for machining a material particularly metal, particularly difficult-to-machine metal.

As a starting point of the present invention the present inventors have found that, by dispersing fine particles of boron nitride, as an extreme pressure agent, contained in the water-soluble lubricant for metal machining, in particular fine particles of boron nitride of the crystalline turbostratic structure, exhibiting superior dispersion properties and lubricating properties, in a base oil, pulverizing the resulting mixture, by emulsifying the pulverized mass in water to form an oil droplet-in-water (o/w) type emulsion for dividing and isolating the fine particles of boron nitride in an oil-water interface to prevent re-coagulation, and by confining the fine particles of boron nitride in the interface along with the oil droplet to suppress precipitation of the fine particles of boron nitride based on the buoyancy of oil. This finding has led to the completion of the present invention.

In one aspect, the present invention provides a water-soluble lubricant for metal machining wherein an oil system, comprising a base oil and an effective amount of fine particles of boron nitride of a crystalline turbostratic structure, dispersed in the base oil, is emulsified in a water system, using an emulsifier, whereby the lubricant exhibits improved dispersibility and emulsion stability of the fine particles of boron nitride by the fine particles of boron nitride being emulsified and dispersed so as to be freed from precipitation.

In another aspect, the present invention provides a water-soluble lubricant for metal machining wherein an oil system, comprising a base oil and an effective amount of fine particles of boron nitride of a hexagonal system and/or a crystalline turbostratic structure (t-BN), with an average particle size of primary particles not larger than 1 μm (i.e., submicron order), whereby the lubricant exhibits improved dispersibility and emulsion stability of the fine particles of boron nitride by the fine particles of boron nitride being emulsified and dispersed so as to be freed from precipitation.

According to a further aspect, there is provided an aqueous lubricant comprising 5 to 6000 ppm (particularly less than 0.1%) by weight of boron nitride particles which is obtained by diluting a mixture solution obtained by emulsifying, into the aqueous system (phase), an oil system (phase) in which an effective amount of boron nitride particles of the crystalline turbostratic structure is dispersed.

According to a still further aspect of the present invention, there is provided a process for producing an article through machining a material (preferably metal) using an aqueous lubricant (lubricant) containing a least effective amount of specific boron nitride of fine particles. The aqueous lubricant typically comprises 5 ppm to 6000 ppm by weight of crystalline turbostratic boron nitride particles (t-BN). The boron nitride particles are present in the diluted lubricant preferably 150 to 3000 ppm, more preferably 175 to 500 ppm for cutting, whereas preferably 5 to 100 ppm, more preferably 10-75 ppm for grinding.

PREFERRED EMBODIMENT OF THE INVENTION

As a lubricant base oil, forming the water-soluble lubricant, mineral oil, synthetic oil, animal oil, plant oil or mixtures thereof, may be used. There is no particular limitation to the mineral oil, synthetic oil, animal oil or plant oil, since any suitable such oil, routinely used as the base oil for the metal machining oil, may be used. As the mineral oil, purified mineral oil, such as ISO VG10 to ISO VC460, is preferred. The mineral oil used may be paraffinic or naphthenic, as desired. As the synthetic oil, polyol esters, polyglycols, poly-α-olefins, α-olefins, n-paraffins, i-paraffins, alkylbenzenes and polyethers, may be used. As animal and plant oils, beef fat, rapeseed oil, soybean oil, sunflower oil, safflower oil, castor oil, coconut oil, or coconut shell oil, may be used. These base oils may be used alone or in combination. The mineral oil, synthetic oil, animal oil and the plant oil may be used in combination.

Fine particles of boron nitride, making up the water-soluble lubricant, are featured by being chemically stable as compared to other solid lubricants, such as graphite, and by not being oxidized in air up to approximately 1000 degrees C. Boron nitride (BN), a compound composed of boron and nitrogen, has polymorphic structures of substantially the same crystalline structures as carbon. Specifically, amorphous boron nitride, referred to below as 'a-BN', boron nitride of the hexagonal system, having hexagonal net layers repeated at a period of two layers, referred to below as 'h-BN', boron nitride of a rhombohedral crystalline system, having hexagonal net layers repeated at a period of three layers, referred to below as 'r-BN', boron nitride of a turbostratic layer structure having hexagonal net layers layered at random, referred to below as 't-BN' (turbostratic BN), and a high pressure phase boron nitride of the cubic system, referred to below as 'c-BN'.

The h-BN crystal is known to exhibit cleavage properties comparable to those of the graphite crystallines of the hexagonal system and satisfactory solid lubricating properties. These lubricating property of the h-BN crystal is derived from the van der Waals linkage with weak bonding between two-dimensional hexagonal net structures, as in the case of graphite. It is understood that the h-BN crystal exhibits marked cleavage property in the plane of weak linkage, with the crystal grains cleft in flakes between the layers being slippery relative to one another.

In the present specification, crystalline boron nitride in which, although the two-dimensional crystalline structure is developed, the layered state (lamination state) across the neighboring layers is not so developed as h-BN, with the hexagonal net layers being layered between two neighboring layers at random to present a turbostratic structure, is termed crystalline turbostratic BN (i.e., t-BN). The structure of this crystalline t-BN is featured by characteristic peaks, obtained by measuring a powder X-ray diffraction spectra, and has a diffraction pattern shown in, for example, FIG. 2 of the JP Patent Kokai JP-A-10-203807 (U.S. Pat. No. 6,306,358B1).

The fine particles of crystalline t-BN may be synthesized with a high yield by, for example, heating a feedstock mixture containing boric anhydride and urine (with alkaline boric acid, such as sodium borate, as an optional component), in a reaction vessel kept in a non-oxidizing atmosphere, in such a manner as to generate a-BN by reaction at a temperature not higher than approximately 1100 degrees C., preferably not higher than 950 degrees C., then heating the reaction product at a temperature not lower than approximately 1200 degrees C. and not higher than 1500 degrees C., preferably at a temperature of 1200 degrees C. to 1400 degrees C. and more preferably at a temperature of 1250 degrees C. to 1350 degrees C., to crystallize a-BN to t-BN. The so produced reaction product is purified by washing with water, preferably with hot water, and with acid, as necessary, to remove soluble components, such as alkalis or boron oxide. This yields fine particles of crystalline t-BN, with the average particle size of the primary particle not larger than 1 μm at a high yield on the inexpensive mass production basis. With this synthesizing method, the particle size of the primary particle may be changed by changing the temperature and time duration of crystallinelization to synthesize particles of boron nitride in which co-exist h-BN and crystalline t-BN. This synthesis method is explained in detail in the JP Patent Kokai JP-A-10-203807 (U.S. Pat. No. 6,306,358B1)), the contents of which are incorporated herein by reference.

The crystalline t-BN, synthesized and purified as described above, are in the form of secondary particles composed of purified fine primary particles, with the particle size usually on the order of 1 μm or less, coalescing together. If dispersed forcibly, the majority of these secondary particles are comminuted and dispersed into fine particles of crystalline t-BN as primary particles. For this dispersion, the secondary particles may be disintegrated and dissociated into fine primary particles having an average particle size not larger than 1 μm (generally submicron), preferably not larger than 0.5 μm, more preferably not larger than 0.3 μm and most preferably not larger than 0.1 μm, by wet comminution or dry comminution. For wet comminution, a shearing mill, such as attrition mill, ball mill or a roll mill, having two or more rolls, using media of beads or balls of ceramics, such as zirconia, as necessary, may be used. For dry comminution, a jet mill, for example, may be used. The fine particles of the crystalline t-BN are not hygroscopic, contrary to the a-BN particles, are stable and exhibit anti-oxidation properties. With the above-described manufacturing method, the h-BN may similarly yield fine particles exhibiting similar grain size distribution, while fine particles of crystalline boron nitride, mainly composed of crystalline t-BN and partially containing h-BN, may also be mass-produced. That is, if heat-treated at a temperature not less than 1450 degrees C., fine crystals of crystalline t-BN begin to be converted into h-BN to yield a powder mixture of t-BN and h-BN. The fine particles of boron nitride, dispersed into the water-dilutable lubricant for metal machining, exhibit superior lubricating properties in case the fine particles of the crystalline t-BN are contained in a larger proportion. For exhibiting superior lubricating properties, the fine particles of crystalline t-BN account for not less than 50 wt % (preferably not less than 80 wt % and more preferably not less than 90 wt %) of fine particles of boron nitride contained in the water-soluble lubricant (oil agent) for metal machining. The content of the fine particles of crystalline t-BN in the fine particles of boron nitride may be measured by comparing the intensity of the diffraction spectra, obtained on powder X-ray diffraction (area occupied by the diffraction spectra), to that of the powder X-ray diffraction of the standard fine particles of boron nitride having a known mixing proportion.

The h-BN particles and the fine particles of crystalline t-BN are formed by crystalline particles exhibiting the cleavage property. The fine particles of h-BN and the fine particles of crystalline t-BN, in particular the fine particles of crystalline t-BN, exhibit superior solid lubricating properties.

The finer the fine particles of h-BN and those of crystalline t-BN, the better are the lubricating properties exhibited by these fine particles of h-BN and of crystalline t-BN, even with a very small amount of addition of the particles (e.g., tens ppm to hundreds ppm in the diluted lubricant upon machining. Thus, the average particle size of the fine particles of boron nitride, inclusive of the secondary particles, in the water-soluble lubricant, is preferably not larger than 1 μm. If the fine particles of boron nitride are pulverized by e.g. a mill, the secondary particles may be dispersed into fine particles, composed of fine primary particles, comparatively readily.

There is an adequate economically desirable content of the fine particles of boron nitride in the water-soluble lubricant for metal machining, depending on conditions of use. However, for imparting optimum lubricating effect and for covering a broad range of lubricating conditions, the content of the fine particles of boron nitride in the water-soluble lubricant is preferably 0.1 to 35 wt % in the mother liquid state before dilution upon use. The reason is that, if the content is not larger than 0.1 wt %, the lubricating effect is small, whereas, if the content exceeds 35 wt %, the particles cannot be dispersed homogeneously with ease and the fluidity is lost so that optimum lubricating properties cannot be displayed. For displaying the lubricating properties with high cost performance, the content of the fine particles of boron nitride is set most preferably to 0.1 to 25 wt %.

In the practical use the mother lubricant is diluted with water, into a concentration range by weight typically of 5 ppm to 6000 ppm of crystalline t-BN or a mixture of crystalline t-BN and h-BN.

With the fine particles of crystalline t-BN, having a developed two-dimensional crystalline structure, the primary particles present substantially disc-like or substantially spherical shape, while exhibiting superior lubricating properties. The shape of these primary particles may be observed by a photo of a scanning electron microscope (SEM), and is as may be seen from a photo by SEM shown in FIG. 5 of the JP Patent Kokai JP-A-10-203807. According to the present invention, since the addition of the fine particles of crystalline t-BN affords superior lubricating properties to the water-soluble lubricant for metal machining, not less than 50 wt %, preferably not less than 70 wt % and more preferably substantially all of the primary particles contained in the water-soluble lubricant for metal machining present substantially disc-like or substantially spherical shape. It may be understood that the reason the primary particles of the crystalline t-BN are not in the form of hexagonal plate, as contrasted to the crystalline particles of h-BN, is that the crystalline t-BN does not have regular layered relationship between neighboring layers of the two-dimensional net layers.

As an emulsifier for the water-soluble lubricant of the present invention, anionic surfactants, non-ionic surfactants or mixtures thereof may be used. In case a mineral oil is used as a base oil for the lubricant oil, the HLB (hydroplethile-lyophile balance) of the emulsifier is preferably on the order of 10 to 18 and more preferably 12 to 16. In case synthetic oil, animal oil or plant oil is used as the base oil for the lubricant oil, or in case the amount of addition of the additive agent is large, it is necessary to make a check from time to time, because the HLB is likely to be changed. The content of the emulsifier is preferably 0.1 to 30 wt % and more preferably 0.1 to 20 wt %, based on the total weight of the entire composition.

The anionic surfactants may be enumerated by (i) soap made from natural beef fat, coconut oil or palm oil, rosin soap, carboxylates, such as carboxylates of alkyl ethers, (ii) sulfonates, such as straight-chained alkyl benzene sulfonates, α-olefin sulfonates, dialkyl sulfosuccinates or naphthalene sulfonates, (iii) sulfuric acid ester salts, such as alkyl sulfuric acid ester salts or alkyl ether sulfuric acid ester salts, and (iv) phosphoric acid ester salts and acyl-N-methyl taurine salts. The non-ionic surfactants may be enumerated by (v) ester type surfactants, such as fatty acid esters, sorbitan fatty acid esters and sucrose fatty acid ester salts, (vi) ether type surfactants, such as polyoxyethylene alkyl ethers, polyoxyethylene alkyl ethers, a part of ethylene oxide of which is replaced by propylene oxide, polyoxyethylene alkyl phenyl ethers, and polyoxyethylene-polyoxypropylene glycols, (vii) ester-ether type surfactants, (viii) fatty acid alkanol amide type surfactants, and alkyl polyglycides. Since the surfactants may or may not be compatible with the base oil or with other additives, and emulsification tends to become unstable depending on the combinations, it is necessary to make selection and check from time to time for use.

In preparing the water-soluble lubricant for metal machining, according to the present invention, the aforementioned base oil, fine particles of boron nitride and the emulsifier are used. An oil system, comprising a base oil in which the fine particles of boron nitride are dispersed and contained, is added to a water system (phase) and the resulting mixture is stirred at a high speed by a stirrer/mixer, such as a mixer, a homogenizer or a colloid mill, preferably a homogenizer, for dispersion and emulsification of fine particles.

Prior to this high speed agitation, the fine particles of boron nitride are disintegrated and mixed, along with the base oil, for dispersion sufficiently finely and homogeneously, using one of a variety of mills, mixers and homogenizers. Preferably, the fine particles of boron nitride are disintegrated and mixed with a minor quantity of the base oil at the outset, in which case the chance of the fine particles of boron nitride colliding against one another is increased to enable finer disintegration. The average particle size of an oil droplet, containing the fine particles of boron nitride, thus dispersed and emulsified, is not larger than 2 μm, preferably not larger than 1 μm. As the particles of boron nitride become finer, the particles of boron nitride may be suppressed from being precipitated to stabilize the dispersion and to display a more stable lubricating action.

Prior to the high-speed agitation, the emulsifier is added in its entirety to one of the oil system (phase) and the water system (phase), or added in suitably divided amounts to both of these systems. In both of these cases, the emulsifier is mixed and stirred sufficiently in the system or systems. Preferably, the system or systems are usually heated to approximately 60 degrees C. until the selected emulsifier is dissolved moderately. The resultant mass is mixed and stirred. Preferably, both the oil system and the water system are heated, regardless of whether or not the emulsifier is contained therein, since the mixing and stirring provide for facilitated emulsification. After emulsification, the resultant mass is forcibly cooled to close to the ambient temperature, for stabilizing the emulsified state.

In a preferred embodiment of the present invention, an anti-oxidation agent, a viscosity index improver, a pour point depressant, an anti-putrefaction agent, a rust-proofing agent, an oiliness improver, an extreme pressure additive, and a defoaming agent, are added to the oil system and/or the water system, in keeping with the conditions of use.

When the additive is added to the oil system, it is preferred to add the additive after heating the system to 60 degrees C., since the viscosity is thereby lowered to improve the convenience in handling. It is also preferred to heat the oil system to 60 degrees C., after addition, and to then proceed to mixing since this facilitates the dispersion. The additive is preferably added after the fine particles of boron nitride are dispersed and contained in the so dispersed state in the base oil. The reason is that, if the additive is added at the outset, disintegration of the fine particles of boron nitride is retarded, while it becomes difficult to restore the non-agglomerated state. When an additive is added to the water system, an emulsified product is preferably kneaded by a mixer or a homogenizer after the emulsified state is stabilized following the emulsification and cooling. In case the additive is added prior to emulsification, it is necessary to make a check, prior to the addition, that stable emulsification is not obstructed by such advance addition. In case an additive only sparingly soluble in water is added, it is necessary to take a countermeasure such as dissolving the additive in another additive soluble in water at the outset and adding the resulting mass.

As the anti-oxidation agent, (i) a phenolic radical capturing agent, such as 2,6-ditertiary-butyl-paracresol (DBPC), (ii) an amine based radical capturing agent, such as phenyl-α-naphtylamine or dialkyl diphenylamine, (iii) a hydropleteroxide decomposing agent, such as ZnDTP, or (iv) metal inactivating agents, such as benzotriazole, zinc dialkyl dithiophosphates, dialkyl selenium, metal phenates or organic nitride compounds, may be used.

As the viscosity index improvers, polymethacrylates, polyacrylates, polyisobutylene, olefin coplymers, polyalkylstyrene, ethylene-propylene copolymers, or hydrides of styrene-diene copolymers, may be used.

As the pour point depressant, (low molecular weight) polymethacrylates, polyacrylates, chlorinated paraffin-naphthalene condensation products, chlorinated paraffin-phenol condensation products or polyalkylstyrene, may be used.

As anti-putrefaction agents, benzo isothiazoline based compounds, triazine based compounds, phenolic compounds, formaldehyde donating compounds, and salityl anilide based compounds, may be used.

As rust-proofing agents, (i) metal soap and carboxylates, such as amine salts, (ii) carboxylates, such as alkenyl succinic acid derivatives, (iii) sulfonates, such as metal sulfonates and dialkyl naphthalene sulfonates, (iv) oleic acid based agents, such as oleic acid and oleates, (v) ester based agents, such as sorbitan monooleate, (vi) phosphoric acid based or phosphate based agents, such as alkylamine, acidic alkylphosphoricacid esters or dibutyl acidic phosphoric acid esters, may be used.

As the oiliness improvers, higher fatty acids, higher alcohols, fatty acid amines, fatty acid amides or esters may be used.

As the extreme pressure additives, (i) sulfur based additives, such as olefin polysulfides, sulfurized lipids or dibenzyl sulfides, (ii) phosphor-based additives, such as alkyl and allyl phosphoric acid esters, alkyl and allyl sub-esters, amine salts of phosphoric acid esters, thiophosphoric acid esters, and amine salts of thiophosphoric acid esters, and (iii) organometal based additives, such as naphthenates.

As the defoamers, silicone oil, silicone polymers, esters, polyhydric aliphatic alcohols, alkenylsuccinic acid derivatives, metal soaps, polyacrylates and acylated polyamides, may be used.

In a further preferred embodiment of the present invention, there is provided a water-soluble lubricant, containing water-soluble amines, oil-soluble amines and fatty acids in the aforementioned water system. The water-soluble amines may be enumerated by, for example, triethanolamine, triisopropanolamine, methyl diethanolamine, dimetyl ethanolamine, monoisopropanolamine, 2-amino2-methyl-1-propanol, 2-(2-aminoethoxy)ethanol, diethyl monoisopropanolamine, N,N-dibutylaminoethanol, N,N-di-n-butylaminoisopropanol, N,N-di-n-propylaminoisopropanol, N,N-ditertiary butyl diethanolamine, N,N-ethylenediamine (diisopropanol), N,N-ethylenediamine(diethanol), mono-n-butyl diethanolamine, and monoethyl diisopropanolamine. However, the lubricant may further contain other water-soluble amines or inorganic alkalis.

Specifically, these other water-soluble amines or organic alkalis may be enumerated by combinations of one or more of triisopropanolamine and methyl diethanolamine, and one or more of monoisopropanolamine, 2-amino2-methyl-1-propanol and 2-(2-aminoethoxy)ethanol.

As lipid-soluble amines, monocyclohexylamine, dicyclohexylamine, 1,3-bis aminomethyl cycklohexane, metaxylenediamine, morpholine, laurylamine and oleylamine.

As fatty acids, straight-chained and/or branched saturated and/or unsaturated fatty acids and/or dibasic acids, may be used. Examples of these acids include caproic acid, enantoic acid, caprylic acid, pelargonic acid, capric acid, undecanoic acid, dodecanoic acid, tridecanoic acid, pentadecanoic acid, heptadecanoic acid, nonadecanoic acid, lauric acid, myristic acid, palmitinic acid, stearic acid, arachic acid, behenic acid, isostearic acid, elaidic acid, oleic acid, linolic acid, linoleic acid, hydroxyl lauric acid, hydroxy myristic acids, hydroxy palmitinic acid, hydroxy stearic acid, hydroxy arachic acid, hydroxy behenic acid, lysinoleic acid, hydroxy octa decenic acid, sebacic acid, dodecanoic (2) acid, dodecyl succinic acid, lauryl succinic acid, stearyl succinic acid, isostearyl succinic acid, and dimeric acid. The unsaturated fatty acids may be enumerated by heptenic acid, octenic acid, nonenic acid, decylenic acid, undecylenic acid, dodecylenic acid, tridecylenic acid, nonadecenic acid, eicosenic acid, isoheptenic acid, isooctenic acid, isononenic acid, isodecylenic acid, isoundecylenic acid, indodecylenic acid, isotridecylenic acid, heptanedioic acid, octanedioic acid, nonanedioic acid, decanedioic acid, undecanedioic acid, dodecanedioic acid, tridecanedioic acid, isoheptanedioic acid, isooctanedioic acid, isononanedioic acid, isodecanedioic acid, isoundecanedioic acid, indodecanedioic acid, isotridecanedioic acid and neodecenic acid. It is also possible to use fatty acids obtained from natural lipids, such as those derived from animals, fish, plants and cereals.

EXAMPLES

The results of metal machining tests, conducted using the high performance water-dilutable lubricant for machining of the present invention, are hereinafter explained. It is to be noted that these Examples are merely illustrative of the present invention and are not intended to limit the invention.

Example 1

Manufacture of Fine Particles of Crystalline t-BN

An amount of a mixture composed of 3.5 kg of boric anhydride, 5.3 kg of urea, and 0.63 kg of borax ($Na_2B_2O_3.10H_2O$) was charged into a pressure-resistant vessel of stainless steel, with a capacity of 12 liters, that may be sealed, and the temperature was raised to 900 degrees C. over about one hour. The temperature was maintained for about ten minutes at 900 degrees C. to complete the reaction to synthesize a-BN. During the time of the reaction, water and a carbon dioxide gas are discharged from the reaction system to raise the pressure in the reaction vessel. Hence, the inside of the reaction vessel was filled with a mixed gas of a carbon dioxide gas and water (vapor) having a pressure higher than one atmospheric pressure. The reaction product, looking like a calcined product, was crushed to particles not larger than 1 mm in diameter. The resulting crushed product was charged into a vessel of alumina, fitted with a lid and, in this state, charged into an electrical oven kept in a nitrogen gas atmosphere. The crushed product was heated to close to a temperature of 1300 degrees C. over 10 hours, at which the product was maintained for two hours to crystalline t-BN to yield fine particles of crystalline t-BN. During this crystallization, sodium borate, co-existing with a-BN, acts to promote conversion of $\alpha$-BN to crystalline t-BN, and hence fine particles of boron nitride can be synthesized at a high yield. Since sodium borate and other impurities are adhered to the so yielded fine particles of crystalline t-BN, the product was purified by washing with ion exchanged water maintained at approximately 80 degrees C. to yield approximately 0.63 kg of fine particles of crystalline t-BN (yield calculated as boron: ca. 70%).

The so yielded fine particles of crystalline t-BN were analyzed, using an X-ray diffraction apparatus. The result of the analyses indicated peaks characteristic of crystalline t-BN. FIGS. 2 and 7 of the JP Patent Kokai JP-A-10-203807 indicates typical examples thereof.

Example 2

Preparation of a High Performance Water-Dilutable Lubricant

A high performance water-dilutable (mother) lubricant was prepared as follows: Three sorts (Nos. 1 to 3) of products of the high performance water-dilutable lubricant for metal machining, shown in Tables 1 to 2, were prepared. Three sorts of starting materials, namely an oil-based material, a water-based material and soap, were used for preparing the products.

First, an oil-based system was prepared. A machine oil No. 46 and t-BN were charged separately into a vessel and thoroughly stirred and mixed together at 7000 rpm for ten minutes, using a homogenizer (Polytron low-noise homogenizer manufactured by KINEMATICA AG, model number of the main body unit: PT6100; generator shaft model number: DA6050/2; provided that DA6050/6 was used only for the emulsifying operation).

The remaining starting materials for the oil system, excepting polyoxyethylene polyoxypropylene alkylether, as a nonionic surfactant for the emulsifier, were added to the above mixture and warmed to 60 degrees C. with hot water. The resulting product was thoroughly stirred and mixed at 7000 rpm for ten minutes using the homogenizer.

This mixture was added by polyoxyethylene polyoxypropylene alkylether and warmed on a hot water bath to 60 degrees C. The resulting mass was manually stirred and mixed thoroughly, using a glass rod.

As a parallel operation, a water-based system was prepared. Water and polyoxyethylene polyoxypropylene alkylether were charged into a vessel and warmed on the hot water bath to 60 degrees C. The resulting product was manually stirred and mixed thoroughly, using a glass rod.

To this water-based system was added the oil system, previously prepared, and the resulting mass was emulsified by thoroughly agitating and mixing at 7000 rpm for three minutes using the homogenizer. The vessel containing the resulting product was immersed in tap water, and the resulting product was cooled under stirring until the temperature was lowered to not higher than 30 degrees C. Thereafter, in case where soap was not used, a silicone defoaming agent was directly added and thoroughly stirred and mixed at 7000 rpm for three minutes, using a homogenizer.

856 g of soap, in an amount larger than the amount required for the present preparation, was prepared separately. A coconut oil fatty acid was dissolved on a hot water bath and a required amount thereof was charged into a vessel. All of the other feedstock materials were charged into the vessel and thoroughly agitated and mixed by a homogenizer at 7000 rpm for ten minutes.

Each required amount of the so prepared soap was added in a required amount to each portion of the aforementioned emulsified product and the resulting mass was thoroughly agitated and mixed at 7000 rpm for three minutes, using a homogenizer. By the above process, high performance water-dilutable lubricants, having the compositions shown in Tables 1 to 3, were prepared. Of these products, the products Nos. 1 and 2 were measured as to particle size distribution of oil droplets, using a laser diffraction type particle size distribution measurement device (SALD-2000 manufactured by SHIMAZU SEISAKUSHO). It was found that the average value and the standard deviation of the product No. 1 were 0.624 μm and 0.103 μm, respectively, while those of the product No. 2 were 0.699 μm and 0.094 μm respectively. Thus, the average values plus 3σ for the products Nos. 1 and 2 were found to be 0.933 μm and 0.981 μm, respectively. As may be seen from this, the particle size of the majority of the oil droplets was lesser than 1 μm.

TABLE 1

Compositions of high performance water-dilutable lubricant No. 1

| No. | | feedstock | ratio | weight |
|---|---|---|---|---|
| 1 | oil-system | machine oil No. 46 | 41.850% | 837.0 g |
| | | t-BN | 0.800% | 16.0 g |
| | | polyisobutylene | 2.500% | 50.0 g |
| | | petroleum sodium sulfonic acid | 4.000% | 80.0 g |

TABLE 1-continued

| Compositions of high performance water-dilutable lubricant No. 1 | | | | |
|---|---|---|---|---|
| No. | | feedstock | ratio | weight |
| | | akkenyl succinic acid | 1.200% | 24.0 g |
| | | polyoxyethylene polyoxypropylene alkylether | 3.600% | 72.0 g |
| | water-system | water | 42.000% | 840.0 g |
| | | polyoxyethylene polyoxypropylene alkylether | 4.000% | 80.0 g |
| | | silicone defoaming agent | 0.050% | 1.0 g |
| | | total | 100.000% | 2,000.0 g |

TABLE 2

| Composition of high performance water-dilutable lubricant No. 2 | | | | |
|---|---|---|---|---|
| No. | | feedstock | ratio | weight |
| 2 | oil-system | machine oil No. 46 | 37.060% | 741.2 g |
| | | t-BN | 0.800% | 16.0 g |
| | | phosphate | 2.400% | 48.0 g |
| | | aliphatic ester | 2.000% | 40.0 g |
| | | sorbitane monooleate | 1.600% | 32.0 g |
| | | polyisobutylene | 0.400% | 8.0 g |
| | | polymethacrylate | 0.400% | 8.0 g |
| | | polyoxyethylene polyoxypropylene alkylether | 3.240% | 64.8 g |
| | water-system | water | 37.800% | 756.0 g |
| | | polyoxyethylene polyoxypropylene alkylether | 3.600% | 72.0 g |
| | soap | coconut oil fatty acid | 3.00% | 60.0 g |
| | | monoisopropanolamine | 0.50% | 10.0 g |
| | | dicyclohexylamine | 0.50% | 10.0 g |
| | | monomethyl diethanolamine | 3.00% | 60.0 g |
| | | silicone defoaming agent | 0.05% | 1.0 g |
| | | water | 2.90% | 58.0 g |
| | | benzoisothiazoline | 0.75% | 15.0 g |
| | | total | 100.000% | 2,000.0 g |

TABLE 3

| Compositions of high performance water-dilutable lubricant for metal machining No. 3 | | | | |
|---|---|---|---|---|
| No. | | feedstock | ratio | weight |
| 3 | oil-system | machine oil No. 46 | 26.660% | 533.2 g |
| | | t-BN | 4.000% | 80.0 g |
| | | phosphate | 1.200% | 24.0 g |
| | | aliphatic ester | 2.400% | 48.0 g |
| | | sulfurized lipid | 4.000% | 80.0 g |
| | | sorbitane monooleate | 2.400% | 48.0 g |
| | | polyisobutylene | 2.000% | 40.0 g |
| | | polymethacrylate | 2.000% | 40.0 g |
| | | polyoxyethylene polyoxypropylene alkylether | 3.240% | 64.8 g |
| | water-system | water | 37.800% | 756.0 g |
| | | polyoxyethylene polyoxypropylene alkylether | 3.600% | 72.0 g |
| | soap | coconut oil fatty acid | 3.00% | 60.0 g |
| | | monoisopropanolamine | 0.50% | 10.0 g |
| | | dicyclohexylamine | 0.50% | 10.0 g |

TABLE 3-continued

| Compositions of high performance water-dilutable lubricant for metal machining No. 3 | | | | |
|---|---|---|---|---|
| No. | | feedstock | ratio | weight |
| | | monomethyl diethanolamine | 3.00% | 60.0 g |
| | | silicone defoaming agent | 0.05% | 1.0 g |
| | | water | 2.90% | 58.0 g |
| | | benzoisothiazoline | 0.75% | 15.0 g |
| | | total | 100.000% | 2,000.0 g |

Example 3

Machining Test 1

Test Conditions:

(1) machine used: Vertical type machining center, manufactured by Mori Seiki Co. Ltd. (MV-40A)
(2) workpiece: AC8B-T6
(3) tool: New roll tap B-NRT M6×1. 0RH7B, manufactured by OSG
(4) cutting speed: 10 meters/minute
(5) base bore: ϕ5.48×30 mm (reamer finished blind bore, rate of lubricant-wetted surface: 100%)
(6) cutting length: 20 mm
(7) concentration of water-soluble lubricant: 10%(i.e., diluted×10)
(8) number of times of machining: 5

Under the above test conditions, a comparative test was carried out by torque evaluation, using a commercial water-soluble lubricant for metal machining A and the high performance water-dilutable lubricant No. 1 of Table 1. The cutting test was conducted by introducing the cutting lubricant only into the base bore. As a result, it could be confirmed that machining could be carried out using the high performance water-dilutable lubricant No. 1 with a torque 15% lower than with use of the commercial water-soluble cutting lubricant A.

Example 4

Machining Test 2

Test Conditions:

(1) machine used: Precision tapping machine (Megatap 11-G8) marketed by YAMAWA ENGINEERING
(2) workpiece: AC4B
(3) tool: New roll tap B-NRT M6×1. 0RH7B, manufactured by OSG
(4) cutting speed: 10 meters/minute
(5) base bore: ϕ5.50±0.05×25 mm (blind hole)
(6) cutting length: 15 mm
(7) dilution factor of water-soluble lubricant: ×10, ×20, ×50 and ×100
(8) number of times of machining: 20

Under the above test conditions, a comparative test was carried out by torque evaluation, using a commercial water-soluble lubricant for metal machining B and the high performance water-dilutable lubricant No. 2 of Table 2. The cutting lubricant was introduced only into the base hole for conducting the test. As a result, it could be confirmed that the high performance water-dilutable lubricant No. 2 of Table 4 has a machining performance at a high dilution factor higher than that of the commercial water-soluble lubricant for metal machining B and may be used with dilution with a dilution factor not less than 2. The lubricant No. 2 shows significant performance even at a very high dilution factor of X100, in which the diluted lubricant contains t-BN of 0.008% by weight.

TABLE 4

| | average torque[N · cm] | |
|---|---|---|
| dilution factor | Water-soluble cutting lubricant B | High performance water-soluble lubricant for metal machining No. 2 (t-BN wt %) |
| X10 | 76 | 82 (about 0.08%) |
| X20 | 88 | 78 (about 0.04%) |
| X50 | 114 | 87 (about 0.016%) |
| X100 | (fractured) | 98 (about 0.008%) |

Example 5

Machining Test 3

Test Conditions (1) machine used: Machining center MINIMAC-VA manufactured by ROKU-ROKU SANGYO
(2) workpiece: Ti alloy (hardness HRC47 to 48, size: 197×365×40 mm)
(3) tool: Re-ground Hitachi tool Epoch21 CEPU4100 Universal (CEPU cemented carbide Epoch universal end mill); no surface treatment of cemented carbide
(4) cutting speed: 2000 rpm, feed: 200 mm/minute
(5) cut of depth: 1.5 mm
(6) cutting lubricant: the workpiece was placed with its major surface directed upwards and has its both longitudinal ends secured to the machining center. A resin wall with a height of approximately 40 mm was formed on the four sides, evading about 30 mm forward and rearward of the secured portion and the cutting lubricant was poured into the inside of the wall to conduct testing.
(7) cutting pattern: An end mill was placed in a receded right end semicircular recess to cut (i) 180 mm towards left and 10 mm forward, then (ii) 160 mm towards right, and 10 mm forward, 160 mm towards left and 10 mm forward, then (iii) repeat (ii) twice, (iv) 180 mm towards right and 70 mm rearward, thus cutting a sum total of 1460 mm.
(8) dilution factor of water-dilutable lubricant for metal machining: the dilution factor was set to X5 (about 0.8 wt % t-BN) and X3 (about 1.3 wt % t-BN) for the first 260 mm and for the rest, respectively, and a cutting test was carried out using the high performance water-dilutable lubricant No. 3 of Table 3.

Up to now, such workpiece difficult to cut could not be cut with water-soluble cutting lubricant. Hence, an oil-based cutting lubricant was used with a reduced rpm, with the feed of the order of 20 to 50 mm per minute, as a fire extinguisher was readied for use. Conversely, with use of the high performance water-dilutable lubricant No. 3 of the present invention, it has been confirmed that cutting may be carried out at a high speed, with the cutting lubricant being water-dilutable and free of the risk of conflagration. It has also been confirmed that, if the dilution factor of the cutting lubricant is lowered, that is, if the cutting lubricant is denser, the cutting surface may be smoother. After the cutting, the cutting edge was checked. It was seen that no partially proceeding wear was observed.

In the practical machining, the diluted lubricant should contain boron nitride 5 ppm to 6000 ppm (0.6%), preferably 150 to 3000 ppm, more preferably 175 to 500 ppm, for cutting; for grinding 10 ppm to 100 ppm, preferably 15-75 ppm.

The diluted lubricant upon practical machining should contain an oil system in the emulsified state (o/w emulsion form) in an amount of 400 ppm up to 16% by weight. The allowable upper limit of the oil system in the mother lubricant is about 70% by weight.

The emulsifier should be present in the diluted lubricant (working lubricant liquid) in an amount of 10 ppm to 3% by weight, preferably 50 ppm to 2.5% by weight.

The dilution may be done to achieve a relevant concentration of t-BN and other ingredients.

A typical composition of the mother lubricant contains 0.75 to 1.5% t-BN, up to about 70% oil system, about 5-10%, preferably 7% of emulsifier. The dilution for actual machining is about ×5 to ×40, preferably ×20 to ×40, for cutting, whereas ×100 to ×750, (preferably ×100 to ×400, more preferably ×100 to ×200) for grinding.

In the commercial product of the lubricant, a very rough proportion of oil system: water system (inclusive of emulsifier) soap (anti-rusting agent) is 50:40:10 by weight. The oil system may be 10-70% in volume, preferably 10-60% in volume.

The emulsifier in the mother lubricant may be 0.1 to 20%, preferably 0.5 to 18%. The proportion of the emulsifier relative to the oil system ranges preferably from 5 to 30%.

A further high performance water-soluble lubricant No. 4 was prepared as shown in Table 5.

TABLE 5

Composition of Lubricant No. 4

| No. | | feedstock | ratio | weight |
|---|---|---|---|---|
| 4 | oil-system | machine oil No. 46 | 31.375% | 627.5 g |
| | | t-BN | 0.75% | 15.0 g |
| | | phosphate | 1.20% | 24.0 g |
| | | aliphatic ester | 2.40% | 48.0 g |
| | | sulfurized lipid | 4.00% | 80.0 g |
| | | sorbitane monooleate | 2.40% | 48.0 g |
| | | polymethacrylate | 0.375% | 7.5 g |
| | | polyoxyethylene polyoxypropylene alkylether | 3.20% | 64.0 g |
| | water-system | water | 40.00% | 800.0 g |
| | | polyoxyethylene polyoxypropylene alkylether | 3.60% | 72.0 g |
| | soap | coconut oil fatty acid | 3.00% | 60.0 g |
| | | monoisopropanolamine | 0.5% | 10.0 g |
| | | dicyclohexylamine | 0.5% | 10.0 g |
| | | monomethyl diethanolamine | 3.00% | 60.0 g |
| | | silicone defoaming agent | 0.20% | 4.0 g |
| | | water | 3.00% | 60.0 g |
| | | benzoisothiazoline | 0.50% | 10.0 g |
| | | total | 100.000% | 2,000 g |

Example 6

Grinding Test 1

Test Conditions:

(1) machine used: Surface grinder manufactured by Okamoto Machine Works (PSG63DXNC)
(2) workpiece: NAK80(size: 50×35×25 mm)
(3) grinding tool: GC120H (size: 355×38×127 mm)

(4) grinding method: traverse (continuous feed)
(5) peripheral speed of grinder: about 1700 m/min
(6) table speed: about 17 m/min
(7) amount of grinding (rough grinding): 0.095 mm
(8) ground amount (fine grinding): 0.005 mm
(10) depth of cut (rough grinding): 0.01 mm
(11) depth of cut (fine grinding): 0.002 mm
(12) spark out: 2 passes
(13) dilution factor of water-dilutable lubricant: ×100 (using lubricant No. 4 of Table 5)

Using the diluted lubricant No. 4 comparison testing was carried out against a comparative lubricant C (dilution factor× 30) which is commercially available, for evaluating the surface roughness of the finished surface after grinding.

The result is as follows:

| Surface roughness | |
|---|---|
| Comparative lubricant: | Ra = 0.800 μm, RzISO = 4.448 μm |
| Lubricant No. 4: | Ra = 0.359 μm RzISO = 2.311 μm |

Significant improvement was observed even at a very low concentration of t-BN (75 ppm in the diluted lubricant)

Example 7

Grinding Test 2

Test Conditions:
(1) machine used: surface grinder manufactured by Okamoto Machine Works (Testing machine)
(2) workpiece: Al—Mg 5052 (size: 50×35×25 mm)
(3) grinding wheel: GC120H7V (size: 205×16×50.8 mm)
(4) grinding method: traverse (continuous feed)
(5) peripheral speed of grinding wheel: about 1200 m/min
(6) table speed: about 10 m/min
(7) moving speed, forward/backward (rough grinding): 100 m/min
(8) moving speed, forward/backward (fine grinding): 20 m/min
(9) amount of grinding (rough grinding): 0.048 mm
(10) amount of grinding (fine grinding): 0.002 mm
(11) depth of cut (rough grinding): 0.0015 mm
(12) depth of cut (fine grinding): 0.0005 mm
(13) spark out: 2 passes
(14) dilution factor of water-soluble lubricant: ×200 (using lubricant No. 4 of Table 5)

[N.B.]: Emulsion type water-soluble lubricant A, commercially available, was added in a diluted state of ×50, in order to replenish the oil component.

(15) Comparative lubricant: Commercial water-soluble lubricant D of the emulsion type, which is widely used for grinding aluminum, was used with a dilution factor of ×30.

The comparative testing was performed for evaluation of surface roughness of the finished surface. The result is as follows:

| surface roughness | |
|---|---|
| Lubricant No. 4 (×200) | Ry = 0.50 μm |
| Commercial Lubricant B (×30) | Ry = 0.82 μm |

Significant improvement was observed, although a very low concentration of t-BN was used (38 ppm in the diluted lubricant).

Generally, the t-BN concentration may range 15 to 100 ppm, preferably 18 to 80 ppm for the grinding.

For cutting, it may range 150 to 500 ppm, preferably 175 to 400 ppm.

Example 8

Machining Test 4

Test Conditions:
(1) machine used: Vertical Center manufactured by Yamazaki Mazak (NEXUS 410A)
(2) workpiece: Titanium alloy (Ti-6Al-4V)
(3) tool: Cemented carbide end mill manufactured by OSG, U.S.A.
ϕ¾ inch, 10 blades,
(EDP90462011 FL10 DIA¾ inch)
(4) dilution factor of water-soluble lubricant: ×20 (using lubricant No. 5 of Table 6)
t-BN concentration: 375 ppm

[N.B.]: Emulsion type water-soluble lubricant A, commercially available, was added in a diluted state of ×20, in order to replenish the oil component.

(5)

| machining conditions | | |
|---|---|---|
| a. rotation speed of main axis: | 5013 | rpm |
| b. peripheral speed: | 300 | m/min |
| c. feed: | 3,008 | mm/min |
| d. radial depth of cut: | 0.6 | mm |
| e. axial depth of cut: | 38 | mm |
| f. volume of cutting: | 68.6 | cc/min |
| g. cutting length: | 10,360 | mm |

(6) Comparative lubricant: Commercial water-soluble lubricant E of emulsion type, which is used as a chlorine containing compound for a difficult-to-machine metal, was used with a dilution factor of ×20.

The result is as follows:

The high performance water-dilutable emulsion lubricant No. 5 completed the objective cutting for testing with a calm cutting noise. The cutting edge showed very little wear and was in a state that can be continually used further. On the other hand, the commercial water-soluble lubricant E developed a large noise immediately after cutting start, resulting in terminating the cutting at a cutting length of 740 mm. On the cutting edge, occurrence of chipping loaded with debris was observed.

TABLE 6

Composition of Lubricant No. 5

| No. | | feedstock | ratio | weight |
|---|---|---|---|---|
| 4 | oil-system | machine oil No. 46 | 27.00% | 540.0 g |
| | | t-BN | 0.75% | 15.0 g |
| | | phosphate | 1.20% | 24.0 g |
| | | aliphatic ester | 2.40% | 48.0 g |
| | | sulfurized lipid | 8.00% | 160.0 g |
| | | sorbitane monooleate | 2.40% | 48.0 g |
| | | polyisobutylene | 0.375% | 7.5 g |
| | | polymethacrylate | 0.375% | 7.5 g |
| | | polyoxyethylene | 3.20% | 64.0 g |

TABLE 6-continued

| Composition of Lubricant No. 5 | | | | |
|---|---|---|---|---|
| No. | | feedstock | ratio | weight |
| | | polyoxypropylene alkylether | | |
| | water-system | water | 40.00% | 800.0 g |
| | | polyoxyethylene | 3.60% | 72.0 g |
| | | polyoxypropylene alkylether | | |
| | soap | coconut oil fatty acid | 3.00% | 60.0 g |
| | | monoisopropanolamine | 0.5% | 10.0 g |
| | | dicyclohexylamine | 0.5% | 10.0 g |
| | | monomethyl diethanolamine | 3.00% | 60.0 g |
| | | silicone defoaming agent | 0.20% | 4.0 g |
| | | water | 3.00% | 60.0 g |
| | | benzoisothiazoline | 0.50% | 10.0 g |
| | | total | 100.000% | 2,000 g |

In summary the t-BN concentration in the diluted lubricant upon machining is effective from a very low level, e.g., of 5 ppm ranging up to thousands of ppm, e.g., 6000 ppm.

In summary, it has been confirmed that a very low concentration of t-BN in the order of tens to hundreds of ppm demonstrates a significantly superior machining performance which has been never achieved in the art.

The oil system (or phase) should be present in a concentration preferred in the art depending on the use. The emulsifier is also necessary to emulsify oil system in water. The fine t-BN particles are dispersed by the aid of the emulsified oil system, droplets of oil. Soap will also promote the dispersion of oil system, and thus also t-BN.

[Meritorious Effect of the Invention]

With the water-soluble lubricant of the present invention, the fine particles of boron nitride are dispersed and emulsified in fine particulate form, and hence precipitation of boron nitride may be suppressed to provide for stable performance. The cutting/grinding lubricant may be produced which is also desirable as a countermeasure against the risk of conflagration. By the solid lubricating action of boron nitride (primarily crystalline t-BN) and by the cooling action of water, a superior cutting performance and the superior wear resistance proper to the tool are displayed. In particular, by adjusting the proportion of boron nitride in the crystalline tubostratic structure, the lubricant may be used generally for machining and processing ferrous and nonferrous materials, such as steels, aluminum alloys, magnesium alloys and other alloys and particularly for heavy cutting applications, such as titanium alloy or Inconel.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A stable water-dilutable emulsion lubricant for machining, comprising:

an oil system and a water system, said oil system being emulsified as droplets in the water system using an emulsifier, said oil system comprising droplets of a base oil and an effective amount of fine particles of boron nitride of a crystalline turbostratic structure, said fine particles of boron nitride being carried by said base oil system droplets, said oil system droplets carrying said fine particles of boron nitride prior to dispersion in the water system, wherein said oil system droplets have an average particle size of less than 2 μm, with an average primary particle size of primary particles of said fine particles of boron nitride being not larger than 1 μm, said oil system droplets are obtained by dispersing said fine particles of boron nitride in a base oil and pulverizing the mixture, and emulsifying the mixture with an aqueous solution in the presence of an emulsifier to produce the stable water-dilutable emulsion lubricant, the stable water-dilutable emulsion lubricant being substantially free of precipitation of the fine particles of boron nitride, and having an oil to water ratio calculated by dividing an amount of the base oil by weight with an amount of water by weight of between about 0.63 and about 1.

2. A stable water-dilutable emulsion lubricant for machining, comprising:

an oil system and a water system, said oil system being emulsified as droplets in the water system using an emulsifier, said oil system comprising droplets of a base oil and an effective amount of fine particles of boron nitride of a hexagonal system and a crystalline turbostratic structure, with an average primary particle size of primary particles of said fine particles of boron nitride being not larger than 1 μm, said oil system droplets having an average particle size of less than 2 μm, said fine particles of boron nitride being carried by said base oil system droplets, said oil system droplets carrying said fine boron nitride prior to dispersion in the water system, wherein said oil system droplets are obtained by dispersing said fine particles of boron nitride in a base oil and pulverizing the mixture, and emulsifying the mixture with an aqueous solution in the presence of an emulsifier to produce the stable water-dilutable emulsion lubricant, the stable water-dilutable emulsion lubricant being substantially free of precipitation of the fine particles of boron nitride, and having an oil to water ratio calculated by dividing an amount of the base oil by weight with an amount of water by weight of between about 0.63 and about 1.

3. The stable water-dilutable emulsion lubricant as defined in claim 2, wherein said particles of boron nitride of the crystalline turbostratic structure account for not less than 50 wt % of said fine particles of boron nitride.

4. The stable water-dilutable emulsion lubricant as defined in claim 1, wherein the average particle size of primary particles of said fine particles of boron nitride is not larger than 0.5 μm.

5. The stable water-dilutable emulsion lubricant as defined in claim 1, wherein the content of said fine particles of boron nitride is 0.1 to 25 wt % based on the total weight of the lubricant.

6. The stable water-dilutable emulsion lubricant as defined in claim 1, wherein primary particles with an average particle size not larger than 0.3 μm account for not less than 50 wt % of said fine particles of boron nitride.

7. The stable water-dilutable emulsion lubricant as defined in claim 1, wherein not less than 50 wt % of said fine particles of boron nitride as observed by an electron microscope are substantially spherically-shaped or disc-shaped.

8. The stable water-dilutable emulsion lubricant as defined in claim 1, wherein said emulsifier is selected from the group consisting of anionic surfactant and non-ionic surfactant.

9. The stable water-dilutable emulsion lubricant as defined in claim 1, wherein said emulsifier is present in an amount of 0.1 to 20 wt % based on the total weight of the lubricant.

10. The stable water-dilutable emulsion lubricant as defined in claim 1, wherein at least one selected from the group consisting of an anti-oxidation agent, a viscosity index improver, a pour-point depressant, an anti-putrefaction agent, a rust-preventing agent, an oiliness improver, an extreme pressure additive, and a defoaming agent, is added to the oil system or the water system.

11. The stable water-dilutable emulsion lubricant as defined in claim 1, wherein a water-soluble amine, an oil-soluble amine and a fatty acid are contained in said water system.

12. The stable water-dilutable emulsion lubricant as defined in claim 1, wherein said fine particles of boron nitride are present in an amount of 5 ppm to 75 ppm in the lubricant in a diluted state.

13. The stable water-dilutable emulsion lubricant as defined in claim 1, wherein said lubricant is diluted with water or water-soluble or dilutable emulsion lubricant containing no boron nitride.

14. The stable water-dilutable emulsion lubricant as defined in claim 1, wherein said fine particles of boron nitride are present in an amount of 5 ppm to 500 ppm in the lubricant in the diluted state.

15. The stable water-dilutable emulsion lubricant as defined in claim 1, wherein said fine particles of boron nitride are present in an amount of 5 ppm to 100 ppm in the lubricant in the diluted state.

16. A stable water-dilutable emulsion lubricant, comprising:

an oil system and a water system, said oil system being emulsified as droplets in the water system using an emulsifier, said oil system droplets comprising a base oil and an amount of fine particles of boron nitride of crystalline turbostratic structure contained in said oil droplets, said fine particle of boron nitride being present contained in said oil droplets in the amount of 5 ppm to 500 ppm by weight of the lubricant in a diluted state, wherein said oil system droplets are obtained by dispersing said fine particles of boron nitride in a base oil and pulverizing the mixture, and emulsifying the mixture with an aqueous solution in the presence of an emulsifier to produce the stable water-dilutable emulsion lubricant, the stable water-dilutable emulsion lubricant being substantially free of precipitation of the fine particles of boron nitride, and having an oil to water ratio calculated by dividing an amount of the base oil by weight with an amount of water by weight of between about 0.63 and about 1.

17. The stable water-dilutable emulsion lubricant as defined in claim 16, wherein said fine particles of boron nitride comprise at least 50% of boron nitride of crystalline turbostratic structure, with the balance being essentially of a hexagonal structure.

18. A process for producing a product, comprising:

providing a workpiece, providing a stable water-dilutable emulsion lubricant, and machining said workpiece using said lubricant, wherein said lubricant comprises:

an oil system and a water system, said oil system being emulsified as droplets prior to dispersion in the water system using an emulsifier, said oil system droplets comprising a base oil and an amount of fine particles of boron nitride of crystalline turbostratic structure contained in said oil droplets, said oil system droplets having an average particle size of less than 2 μm, said fine particles of boron nitride being contained in said oil droplets in an amount of 5 ppm to 500 ppm by weight of the lubricant in a diluted state, wherein said oil system droplets are obtained by dispersing said fine particles of boron nitride in a base oil and pulverizing the mixture, and emulsifying the mixture with an aqueous solution in the presence of an emulsifier to produce the stable water-dilutable emulsion lubricant, the stable water-dilutable emulsion lubricant being substantially free of precipitation of the fine particles of boron nitride, and having an oil to water ratio calculated by dividing an amount of the base oil by weight with an amount of water by weight of between about 0.63 and about 1.

19. The process as defined in claim 18, wherein the workpiece comprises a metal.

20. The process as defined in claim 18, wherein the workpiece comprises aluminum alloy, magnesium alloy, steel, titanium alloy, or Inconel.

21. The process as defined in claim 18, wherein said machining comprises cutting.

22. The process as defined in claim 18, wherein said machining comprises grinding and said fine particles of boron nitride contained in said oil droplets in an amount of 5 ppm to 100 ppm.

23. The process as defined in claim 18, wherein the workpiece comprises titanium alloy or Inconel.

24. The stable water-dilutable lubricant as defined in claim 16, wherein said average particle size of said oil system droplets is not larger than 1 μm.

25. The stable water-dilutable lubricant as defined in claim 18, wherein said lubricant is obtained by diluting a mother lubricant with water or a water-dilutable lubricant containing no crystalline t-BN.

26. The stable water-dilutable lubricant as defined in claim 1, wherein said average particle size of said oil system droplets is not larger than 1 μm.

27. The stable water-dilutable lubricant as defined in claim 2, wherein said average particle size of said oil system droplets is not larger than 1 μm.

28. The process as defined in claim 18, wherein said average particle size of said oil system droplets is not larger than 1 μm.

29. A process for producing a stable water-dilutable emulsion lubricant, comprising:

providing an oil system;

dispersing fine particles of boron nitride of a crystalline turbostratic structure to form a mixture of said fine particles of boron nitride dispersed in the oil system as primary particles thereof; and adding said mixture into a water system followed by emulsifying the resultant mass until an stable oil-in-water emulsion of oil droplets that carry said fine particles of boron nitride is produced, said stable water-dilutable emulsion lubricant being substantially free of precipitation of the fine particles of boron nitride, and having an oil to water ratio calculated by dividing an amount of the base oil by weight with an amount of water by weight of between about 0.63 and about 1.

30. The stable water-dilutable emulsion lubricant as defined in claim 1, wherein said oil system droplets are obtained by emulsifying the mixture with the aqueous solution in the presence of the emulsifier at an elevated temperature, and cooling the mixture to a temperature of not higher than 30° C.

31. The stable water-dilutable emulsion lubricant as defined in claim 2, wherein said oil system droplets are obtained by emulsifying the mixture with the aqueous solution in the presence of the emulsifier at an elevated temperature, and cooling the mixture to a temperature of not higher than 30° C.

32. The stable water-dilutable emulsion lubricant as defined in claim 16, wherein said oil system droplets are obtained by emulsifying the mixture with the aqueous solution in the presence of the emulsifier at an elevated temperature, and cooling the mixture to a temperature of not higher than 30° C.

33. The process for producing a product as defined in claim 18, wherein said oil system droplets are obtained by emulsifying the mixture with the aqueous solution in the presence of the emulsifier at an elevated temperature, and cooling the mixture to a temperature of not higher than 30° C.

34. The process for producing a stable water-dilutable emulsion lubricant as defined in claim 29, wherein the resultant mass is emulsified at an elevated temperature until an oil-in-water emulsion is produced and the emulsion is cooled to a temperature of not higher than 30° C.

35. A stable water-dilutable mother lubricant for machining, comprising:

oil droplets comprising fine particles of t-BN, said t-BN having an average primary particle size of primary particles not larger than 1 μm; and a water system in which said oil droplets are dispersed as to form a stable oil-in-water emulsion, said stable water-dilutable mother lubricant being obtained by:

dispersing said fine particles of t-BN in a base oil;

emulsifying mixture of the fine particles of t-BN and base oil with an aqueous solution in the presence of an emulsifier at an elevated temperature until an oil-in-water emulsion is produced; and cooling the oil-in water emulsion to a temperature not higher than 30° C. to produce the stable water-dilutable mother lubricant, the stable water-dilutable mother lubricant being substantially free of precipitation of the fine particles of t-BN, and having an oil to water ratio calculated by dividing an amount of the base oil by weight with an amount of water by weight of between about 0.63 and about 1.

* * * * *